US009302484B2

(12) United States Patent
Suzuki et al.

(10) Patent No.: US 9,302,484 B2
(45) Date of Patent: Apr. 5, 2016

(54) INK JET PRINTING DEVICE

(75) Inventors: Masato Suzuki, Chiryu (JP); Masatoshi Fujita, Anjo (JP); Kazuhiro Sugiyama, Minokamo (JP); Akihiro Kawajiri, Chiryu (JP); Kenji Tsukada, Toyota (JP); Yoshitaka Hashimoto, Kariya (JP)

(73) Assignee: FUJI MACHINE MFG. CO., LTD., Chiryu (JP)

( * ) Notice: Subject to any disclaimer, the term of this patent is extended or adjusted under 35 U.S.C. 154(b) by 0 days.

(21) Appl. No.: 14/411,249

(22) PCT Filed: Jun. 27, 2012

(86) PCT No.: PCT/JP2012/066442

§ 371 (c)(1),
(2), (4) Date: Feb. 2, 2015

(87) PCT Pub. No.: WO2014/002221

PCT Pub. Date: Jan. 3, 2014

(65) Prior Publication Data

US 2015/0138263 A1 May 21, 2015

(51) Int. Cl.

| | |
|---|---|
| ***B41J 2/195*** | (2006.01) |
| ***B41J 2/17*** | (2006.01) |
| ***B41J 2/175*** | (2006.01) |

(52) U.S. Cl.

CPC ..... *B41J 2/175* (2013.01); *B41J 2/1752* (2013.01)

(58) Field of Classification Search

USPC ..... 347/7, 84

See application file for complete search history.

(56) References Cited

U.S. PATENT DOCUMENTS

| | | | | |
|---|---|---|---|---|
| 6,269,744 | B1 * | 8/2001 | Blaser et al. | 101/494 |
| 8,619,303 | B2 * | 12/2013 | Miura | 358/1.15 |
| 2010/0208000 | A1 * | 8/2010 | Silverbrook | 347/53 |
| 2011/0273506 | A1 * | 11/2011 | Katoh | 347/17 |

FOREIGN PATENT DOCUMENTS

| | | |
|---|---|---|
| DE | 199 08 841 A1 | 10/1999 |
| JP | 10-133528 | 5/1998 |
| JP | 11-320837 | 11/1999 |
| JP | 2004-167431 | 6/2004 |
| JP | 2005-96152 | 4/2005 |

OTHER PUBLICATIONS

International Search Report issued Jul. 31, 2012, in PCT/JP12/066442 filed Jun. 27, 2012.

Office Action drafted Aug. 28, 2015 in Japanese Patent Application No. 2014-522300 (with unedited computer generated English translation).

* cited by examiner

*Primary Examiner* — Jason Uhlenhake

(74) *Attorney, Agent, or Firm* — Oblon, McClelland, Maier & Neustadt, L.L.P.

(57) ABSTRACT

An inkjet printing device including a head unit that includes an inkjet head, a fixed tank for storing ink to be supplied to the inkjet head, and a tank attachment section to which ink tank for storing ink to be replenished to the fixed tank is exchangeably attached. When ink tanks are exchanged, an ink tank attached to the tank attachment section of head unit is removed by an arm section of the tank exchange mechanism, and an ink tank to be used for exchange removed from tank storage unit is attached to the tank attachment section of the head unit.

14 Claims, 5 Drawing Sheets

EMBODIMENT 2

EMBODIMENT 2

EMBODIMENT 3

INK JET PRINTING DEVICE

TECHNICAL FIELD

The present application is related to an inkjet printing device equipped with a function for automatically exchanging ink tanks.

BACKGROUND ART

Inkjet printing devices are used not just for personal use and office use but in a wide variety of fields, for example, also in the electronic manufacturing world for drawing the patterns for electronic component wiring, insulators, dielectrics and so on, and the patterns for circuit board wiring and resistors and so on. For all inkjet printing devices, exchanging ink tanks which supply ink to the inkjet head is performed manually. Problems occur such as printing defect problems due to ink running out, or productivity decreases due to long ink tank exchange time (printing interruption time), with the inkjet printing device from patent literature 1, (Japanese Unexamined Patent Application Publication Number 2005-96152) In order to solve the above problems, two sub-tanks for storing ink are provided at the ink supply piping between the ink tank and inkjet head, so that the configuration is such that ink can be supplied to the inkjet head from the sub-tank even during ink tank exchange work, so that ink tank exchange work can be performed without interrupting printing operation.

CITATION LIST

Patent Literature

Patent Literature 1: Japanese Unexamined Patent Application Publication Number 2005-96152

SUMMARY OF INVENTION

Problem to be Solved by the Invention

However, with the above inkjet printing device from patent literature 1, because ink tank exchange work must be performed manually, it is troublesome. Further, because the inkjet head moves during printing operation, in order to make ink tank exchange possible, the ink tank must be located outside the movement range of the inkjet head, and the ink tank and inkjet head must be connected with freely deformable ink supply piping. With this configuration, because a large quantity of ink accumulates inside the ink supply piping between the ink tank and inkjet head and in the two sub-tanks, in the end a large quantity of ink remains without being used for printing, meaning there is a lot of ink wasted. Further, if the quantity of ink which accumulates from the ink tank to the inkjet head is large, because the period until that ink is used up becomes longer, ink suffers deterioration due to the ink usage period expiring or the usage environment (temperature and humidity) changing, which means that inkjet head discharge defects and printing defects occur more easily.

Means for Solving the Problem

To solve the above problems, one aspect of the present disclosure is an item with a configuration equipped with a head unit provided with an inkjet head for printing by jetting ink onto a printing target item, a tank attachment section provided on the head unit to which an ink tank for storing ink supplied to the inkjet head is exchangeably attached, a tank storage unit which can store at least one ink tank to be used for exchange, a tank exchange mechanism which as well as removing an ink tank attached to the tank attachment section attaches an ink tank to be used for exchange removed from the tank storage unit to the tank attachment section, and a control means for controlling the ink tank exchange operation of the tank exchange mechanism.

With this configuration, because when ink tanks are exchanged, as well as an ink tank attached to the tank attachment section of the head unit being removed by the tank exchange mechanism, an ink tank to be used for exchange removed from the tank storage unit is attached to the tank attachment section of the head unit, as well as automatic exchange of ink tanks by the tank exchange mechanism being possible, automatic exchange of ink tanks in a short time is possible even in cases in which ink tanks are exchanged after stopping printing operation temporarily, thus it is possible to meet the demand of improving productivity. Further, because the tank attachment section for attaching an ink tank and the inkjet head are provided on the same head unit, the ink supply path between the ink tank attached to the tank attachment section and the inkjet head can be made short, the quantity of ink which accumulates in the ink supply path from the ink tank to the inkjet head can be reduced, and the quantity of wasted ink which remains without being used in the end can be reduced. Further, because the quantity of ink which accumulates from the ink tank to the inkjet head is reduced, the period until that ink is used up can be shortened, and as well as ink being able to be used up within the ink usage expiry period, if it is within the ink usage expiry period, because there is little deterioration of the ink due to changes in the ink usage environment (temperature and humidity), the problems of printing defects and discharge defects from the inkjet head due to deterioration of the ink can be remedied.

In another aspect of the present disclosure, a fixed tank for storing ink to be supplied to the inkjet head is may be provided on the head unit and the configuration is such that ink is replenished to the fixed tank from an ink tank attached to a tank attachment section. If this is done, because a state in which ink supplied from the fixed tank can be maintained in a filled state in the inkjet head during exchanging of ink tanks in the same manner as before exchange, printing operation can be started immediately after ink tank exchange without performing ink filling operation to the inkjet head, and the stopping time for printing operation due to ink tank exchange can be minimized.

Incidentally, for the judgment for the ink tank exchange period, it is acceptable, for example, for the printing operation time to be calculated and, when the calculated printing operation time exceeds a predetermined value, to assume that ink inside the ink tank has just about been depleted and to then exchange ink tanks, but in this case, because an assumed error must be taken into account between the calculated printing operation time and remaining ink quantity (ink consumed quantity), it is necessary to perform ink tank exchange at an early time, which means that the ink inside the ink tank cannot be used up until the end.

For this point, an ink remaining quantity detection means may be provided for detecting the remaining quantity or presence/absence of ink in the ink tank attached to the tank attachment section on the head unit, and to perform ink tank exchange operation of the tank exchange mechanism after judging the exchange period of the ink tank attached to the tank attachment section based on the detection result of the ink remaining quantity detection means. If this is done, it is possible to perform ink tank exchange operation of the tank exchange mechanism when the remaining quantity of ink inside the ink tank is just about zero (equal to or below a judgment threshold value) by detecting this with the ink remaining quantity detection means, and ink tank exchange can always be performed in a state with ink inside the ink tank used up until the end, so that ink inside the ink tank is not wasted.

Also, it is acceptable that, as well as an ink information registration means on which is recorded or memorized ink information including at least one of: ink usage expiry period, storage temperature, and ink type being provided on the storage ink tank or cap section thereof of the tank storage unit, an ink information reading means for reading the ink information from the ink information registration means of the ink tank is provided on the tank storage unit or tank exchange mechanism, such that it is judged whether an ink tank is not appropriate for exchange (for example, the ink usage period has expired, the ink tank is for the wrong ink type, and so on) based on the ink information read at the ink information reading means. If this is done, it is possible to prevent in advance an ink tank not appropriate for exchange being attached to the tank attachment section of the inkjet head, and it is possible to prevent in advance inkjet head discharge defects and printing defects and so on.

In this case, it is acceptable to provide a tank disposal means for disposing of ink tanks not appropriate for exchange from the tank storage unit, or it is acceptable to have a configuration in which the tank exchange mechanism also acts as a tank disposal means, such that ink tanks not appropriate for exchange are removed from the tank storage unit and disposed of to a predetermined disposal location by the tank exchange mechanism.

Also, it is also acceptable to have a configuration in which a bubble discharge means (for example, an ultrasonic generator) for discharging bubbles entrapped inside the ink in the storage ink tank is provided on the tank storage unit. If this is done, high quality ink which does not include bubbles can be supplied to the ink jet head and the printing quality can be improved.

Further, it is also acceptable to have a configuration in which a temperature control means for controlling the temperature of ink inside the storage ink tank to a predetermined temperature is provided on the tank storage unit. If this is done, even in cases in which the ink tank storage period is long or the ink inside the ink tank is ink which is particularly susceptible to deterioration due to changes in the environment temperature, as well as deterioration of ink inside the ink tank being able to be prevented, changes in the viscosity of the ink due to temperature changes can be controlled.

DESCRIPTION OF EMBODIMENTS

The following describes three modes for carrying out the invention, embodiments 1 to 3.

Embodiment 1

Figure 1:
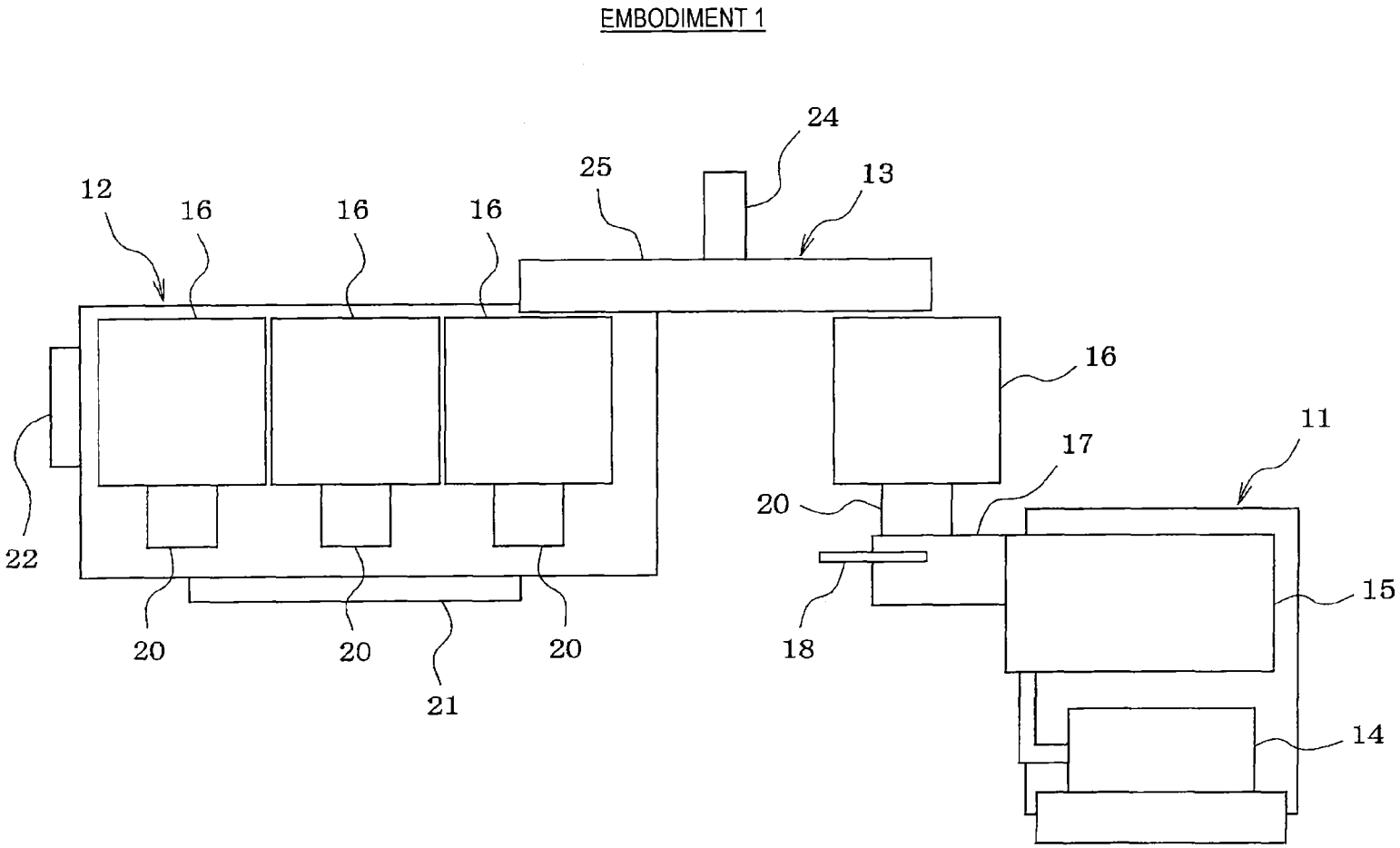
FIG. 1 is a diagram illustrating the configuration of the inkjet printing device of embodiment 1 of the present disclosure.
Figure 2:
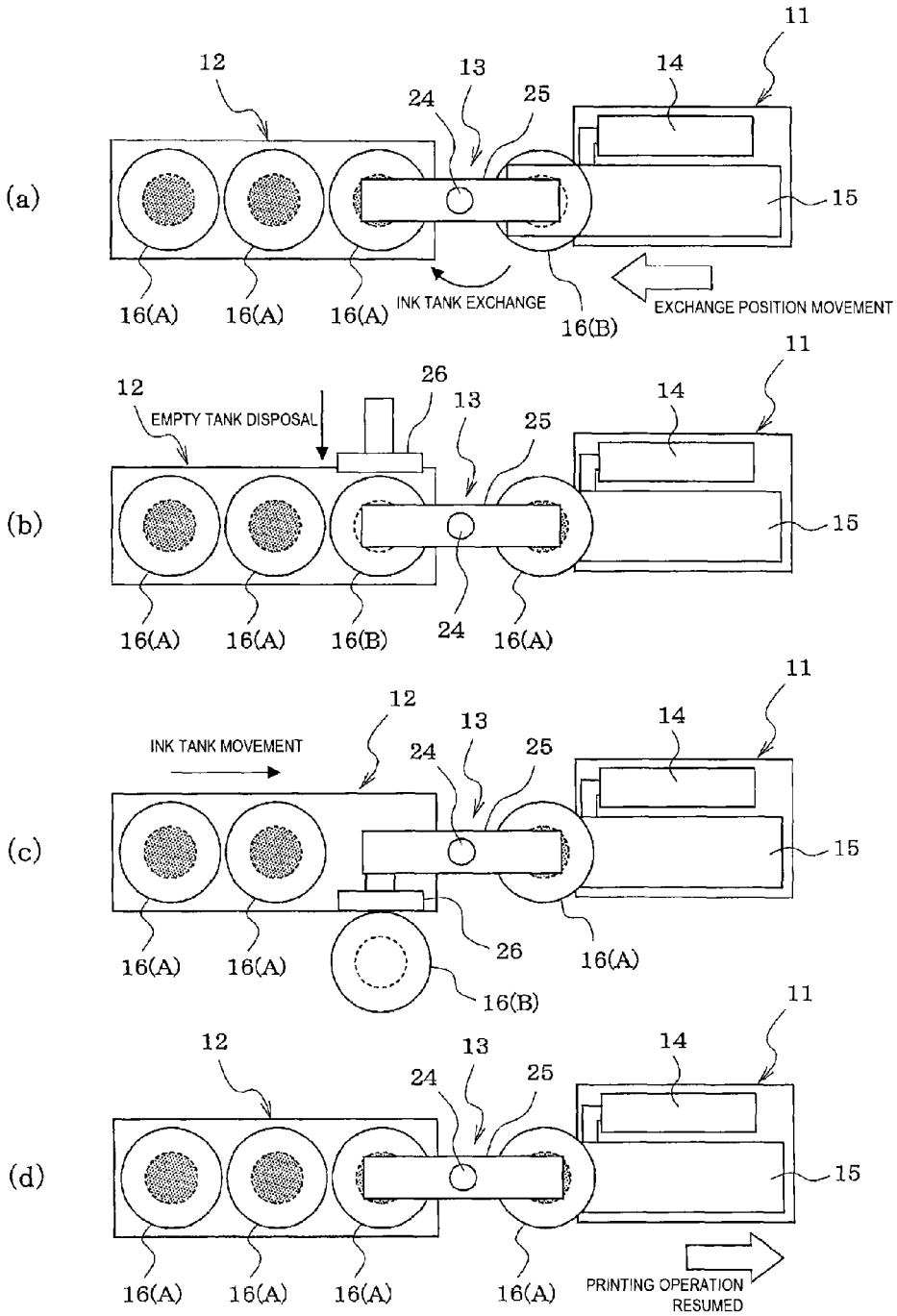
FIG. 2 (*a*) to (*d*) are diagrams illustrating the ink tank exchange operation of embodiment 1 of the present disclosure.

This describes embodiment 1 of the present disclosure based on FIG. 1 and FIG. 2. First, the configuration of the inkjet printing device is described based on FIG. 1.

The inkjet printing device of embodiment 1 is used for drawing, for example, the patterns for electronic component wiring, insulators, dielectrics and so on, and the patterns for circuit board wiring and resistors and so on. This inkjet printing device comprises items such as head unit 11, tank storage unit 12, and tank exchange mechanism 13.

Provided on head unit 11 are: inkjet head 14 for printing by jetting ink onto a printing target item; fixed tank 15 for storing ink to be supplied to this inkjet head 14; and tank attachment section 17 to which ink tank 16 for storing ink to be replenished to this fixed tank 15 is exchangeably attached. The connection mechanism (not shown in the figure) between tank attachment section 17 and ink tank 16 is incorporated into cap section 20 of ink tank 16. Due to this, cap section 20 of ink tank 16 only can be a standardized item, and a general item can be used for the tank section.

Further, ink remaining quantity sensor 18 (ink remaining quantity detection means) for detecting the remaining ink quantity or the presence/absence of ink inside ink tank 16 attached to tank attachment section 17 is provided on head unit 11, and when the remaining quantity of ink inside ink tank 16 is just about zero (equal to or below a judgment threshold value), this is detected by ink remaining quantity sensor 18 and an ink depleted signal from ink remaining quantity sensor 18 is outputted to the control device (control means) of the inkjet printing device.

On the other hand, tank storage unit 12 is configured to be a size which stores at least one ink tank 16 to be used for exchange. Ink is filled into ink tank 16 to be used for exchange and cap section 20 placed on the ink filling mouth of ink tank 16 is maintained in a tightly closed state while inside tank storage unit 12, and when attached to tank attachment section 17, the cap section 20 is opened and the configuration is such that the ink inside ink tank 16 is replenished to fixed tank 15. Ink tank 16 is stored inside tank storage unit 12 with cap section 20 in a state facing down.

Further, temperature control means 21 (for example, thermoelectric element, heater, fan, and so on) for controlling the temperature of the ink inside storage ink tank 16 to a predetermined temperature suitable for storage is provided on tank storage unit 12, such that the ink inside storage ink tank 16 is kept at a predetermined temperature suitable for storage.

Also, bubble discharge means 22 (for example, an ultrasonic generator) for discharging bubbles entrapped inside the ink in storage ink tank 16 is provided on tank storage unit 12. By this, even in cases in which bubbles are entrapped in the ink inside ink tank 16 when ink is filled into ink tank 16 or during transport of ink tank 16, while the ink tank 16 is stored inside tank storage unit 12, bubbles inside the ink in ink tank 16 are discharged by bubble discharge means 22, such that high quality ink which does not include bubbles can be supplied to inkjet head 16.

Tank exchange mechanism 13 comprises linear type arm section 25 which rotates horizontally, moving axis 24 connected to the center of the arm section 25, and a moving power source (not shown in the figure) such as a motor for moving arm section 25 up/down or with horizontal rotation using the moving axis 24, and a gripping member (not shown in the figure) is provided at both ends of the arm section 25 for respectively gripping ink tanks 16. Also, as shown in FIG. 2 (*b*), (*c*), tank disposal means 26 for disposing of empty ink tanks 16 returned to tank storage unit 12 after being removed from head unit 11 by tank exchange mechanism 13 is provided on the tank storage unit 12 side.

Ink tank exchange operation of tank exchange mechanism 13 and empty tank disposal operation of tank disposal means 26 are controlled in the following manner by the control device of the inkjet printing device.

The control device of the inkjet printing device, as well as controlling printing operation, reads the output of ink remaining quantity sensor 18, monitors the remaining quantity of ink (or presence/absence of ink) inside ink tank 16 attached to tank attachment section 17 of head unit 11, and when the remaining quantity of ink inside ink tank 16 is just about zero (equal to or below a judgment threshold value) (or when an ink depleted signal is output from ink remaining quantity sensor 18), starts ink tank exchange operation of tank exchange mechanism 13. In the following description, "16 (A)" indicates an ink tank 16 filled with ink, "16 (B)" indicates an empty ink tank 16 in which the ink is depleted, and when "16" is given this may refer to one of or both "16 (A)" and "16 (B)".

When performing ink tank exchange operation, first, as shown in FIG. 2 (*a*), head unit 11 is moved to an ink tank exchange position adjacent to tank storage unit 12, and empty ink tank 16 (B) on the head unit 11 side is made to be opposite ink tank 16 (A) to be used for exchange inside tank storage unit 12.

After this, as well as the gripping member at one end of arm section 25 of tank exchange mechanism 13 being operated and ink tank 16 (A) to be used for exchange inside tank storage unit 12 being gripped, the gripping member at the other end of arm section 25 is operated and empty ink tank 16 (B) attached to tank attachment section 17 of head unit 11 is gripped. In this state, by raising arm section 25 the two ink tanks 16 (A) and 16 (B) being held at both ends are removed from tank storage unit 12 and tank attachment section 17 of head unit 11, and in this state, as shown in FIG. 2 (*b*), arm section 25 is rotated 180 degrees, and as well as empty ink tank 16 (B) being positioned above tank storage 12, ink tank 16 (A) to be used for exchange is positioned above tank attachment section 17 of head unit 11.

In this state, by lowering arm section 25, as well as empty ink tank 16 (B) being loaded onto tank storage unit 12, ink tank 16 (A) to be used for exchange is attached to tank attachment section 17 of head unit 11. Here, in the process of cap section 20 of ink tank 16 (A) to be used for exchange being attached to tank attachment section 17, the cap section 20 is opened and the ink inside ink tank 16 (A) is replenished to fixed tank 15. After this, the gripping members of arm section 25 are opened and the grip on ink tanks 16 (A) and (B) is released, and arm section 25 is raised to the original standby position. By this, a state in which printing operation can be started is reached.

After this, as shown in FIG. 2 (*c*), tank disposal means 26 is operated and empty tank 16 (B) is ejected from tank storage unit 12. After this, as shown in FIG. 2 (*d*), each ink tank 16 inside tank storage unit 12 is moved by the arrangement pitch of ink tanks 16 towards the tank exchange mechanism 13 side to prepare for the next ink tank exchange operation. A moving means (not shown in the figure) for moving ink tanks 16 to the tank exchange mechanism 13 side is provided on tank storage unit 12.

It is fine so long as operators check the remaining quantity of ink tanks 16 (A) to be used for exchange stored in tank storage unit 12, and replenish ink tanks 16 (A) to be used for exchange to tank storage unit 12 before the remaining quantity becomes zero. Here, even if the remaining quantity of ink tanks 16 (A) to be used for exchange inside tank storage unit 12 reaches zero, so long as an ink tank 16 (A) to be used for exchange is replenished to tank storage unit 12 before the ink inside the ink tank 16 (A) attached to head unit 11 runs out, because ink tank exchange operation can be started immediately as soon as ink runs out in the ink tank 16 (A) attached to head unit 11, there is no problem.

With the embodiment 1 described above, because when ink tanks 16 are exchanged, as well as an ink tank 16 attached to tank attachment section 17 of head unit 11 being removed by tank exchange mechanism 13, ink tank 16 to be used for exchange removed from tank storage unit 12 is attached to tank attachment section 17 of head unit 11, as well as automatic exchange of ink tanks 16 by tank exchange mechanism 13 being possible, automatic exchange of ink tanks 16 in a short time is possible even in cases in which ink tanks 16 are exchanged after stopping printing operation temporarily, thus it is possible to meet the demand of improving productivity.

Further, because tank attachment section 17 for attaching an ink tank 16 and inkjet head 14 are provided on the same head unit 11, the ink supply path between the ink tank 16 attached to tank attachment section 17 and inkjet head 14 can be made short, the quantity of ink which accumulates in the ink supply path from the ink tank 16 to inkjet head 14 can be reduced, and the quantity of wasted ink which remains without being used in the end can be reduced. Further, because the quantity of ink which accumulates from the ink tank 16 to inkjet head 14 is reduced, the period until that ink is used up can be shortened, and as well as ink being able to be used up within the ink usage expiry period, if it is within the ink usage expiry period, because there is little deterioration or viscosity changes in the ink due to changes in the ink usage environment (temperature and humidity), the problems of printing defects and discharge defects from inkjet head 14 due to deterioration of the ink can be remedied.

Further, with embodiment 1, fixed tank 15 for storing ink to be supplied to inkjet head 14 is provided on head unit 11, and because the configuration is such that ink is replenished to fixed tank 15 from the ink tank 16 attached to tank attachment section 17, ink supplied from fixed tank 15 can be maintained in a filled state in inkjet head 14 even during exchanging of ink tanks 16 in the same manner as before exchange. By this, printing operation can be started immediately after exchanging ink tanks 16 without performing ink filling operation to inkjet head 14, and the stopping time for printing operation due to exchanging ink tanks 16 can be minimized.

Incidentally, for the judgment for the ink tank 16 exchange period, it is acceptable, for example, for the printing operation time to be calculated and, when the calculated printing operation time exceeds a predetermined value, to assume that ink inside the ink tank 16 has just about been depleted and to then exchange ink tanks 16, but in this case, because an assumed error must be taken into account between the calculated printing operation time and remaining ink quantity (ink consumed quantity), it is necessary to perform exchange of ink tanks 16 at an early time, which means that the ink inside the ink tank 16 cannot be used up until the end.

Here, with embodiment 1, because ink remaining quantity sensor 18 for detecting the remaining quantity (or the presence/absence) of ink inside the ink tank 16 attached to tank attachment section 17 is provided on head unit 11, it is possible to perform ink tank exchange operation of tank exchange mechanism 13 when the remaining quantity of ink inside the ink tank 16 is just about zero (equal to or below a judgment threshold value) by detecting this with ink remaining quantity sensor 18, and exchange of ink tanks 16 can always be performed in a state with ink inside the ink tank 16 used up until the end, so that ink inside the ink tank 16 is not wasted.

Also, with embodiment 1, because temperature control means 21 for controlling the temperature of ink inside the storage ink tank 16 to a predetermined temperature is provided on tank storage unit 12, deterioration of ink inside the ink tank 16 can be prevented even if the storage period of ink tank 16 is lengthened, or the ink inside the ink tank 16 is ink which is particularly susceptible to deterioration due to changes in the environment temperature.

Embodiment 2

Figure 3:
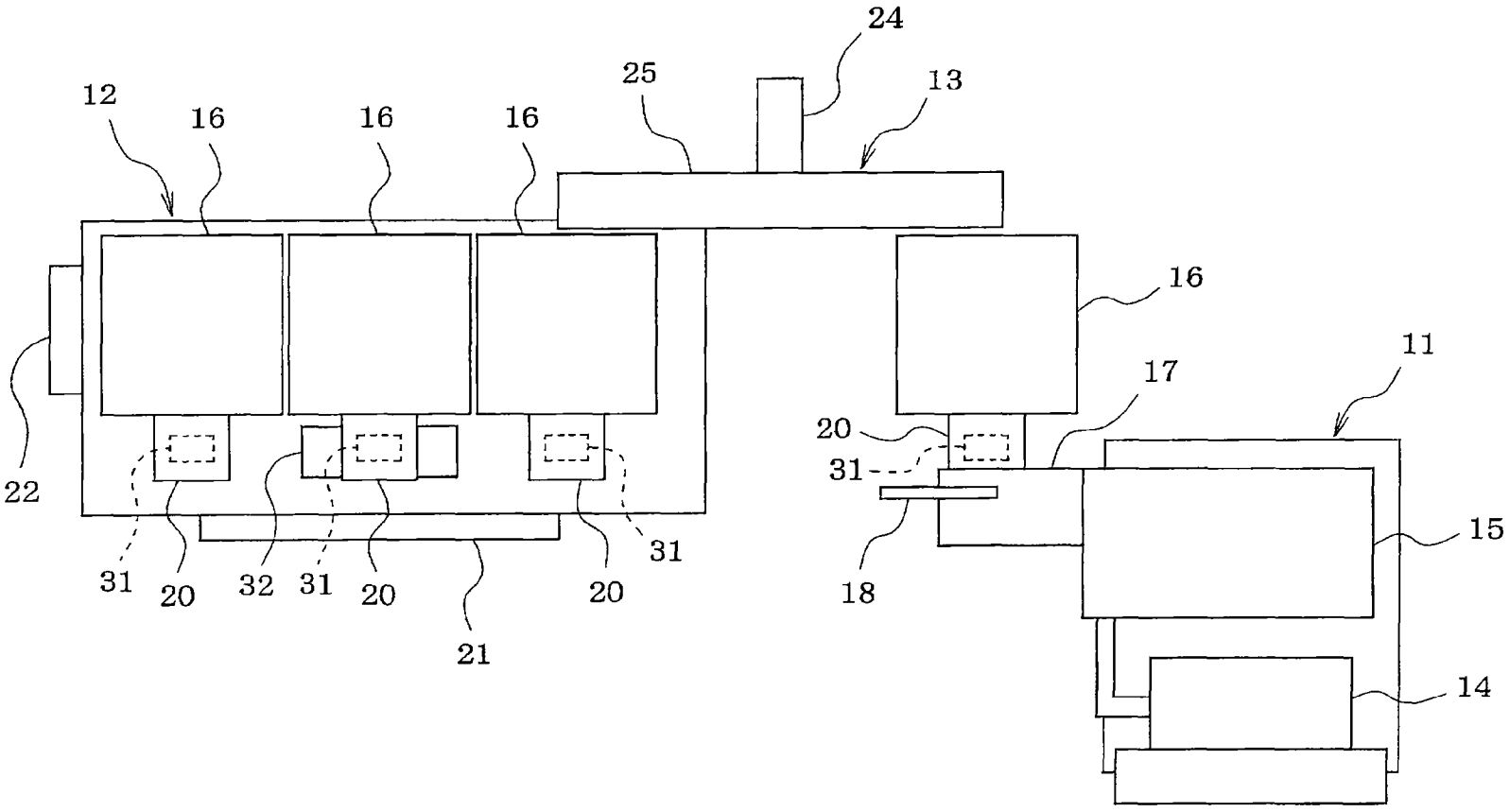
FIG. 3 is a diagram illustrating the configuration of the inkjet printing device of embodiment 2 of the present disclosure.
Figure 4:
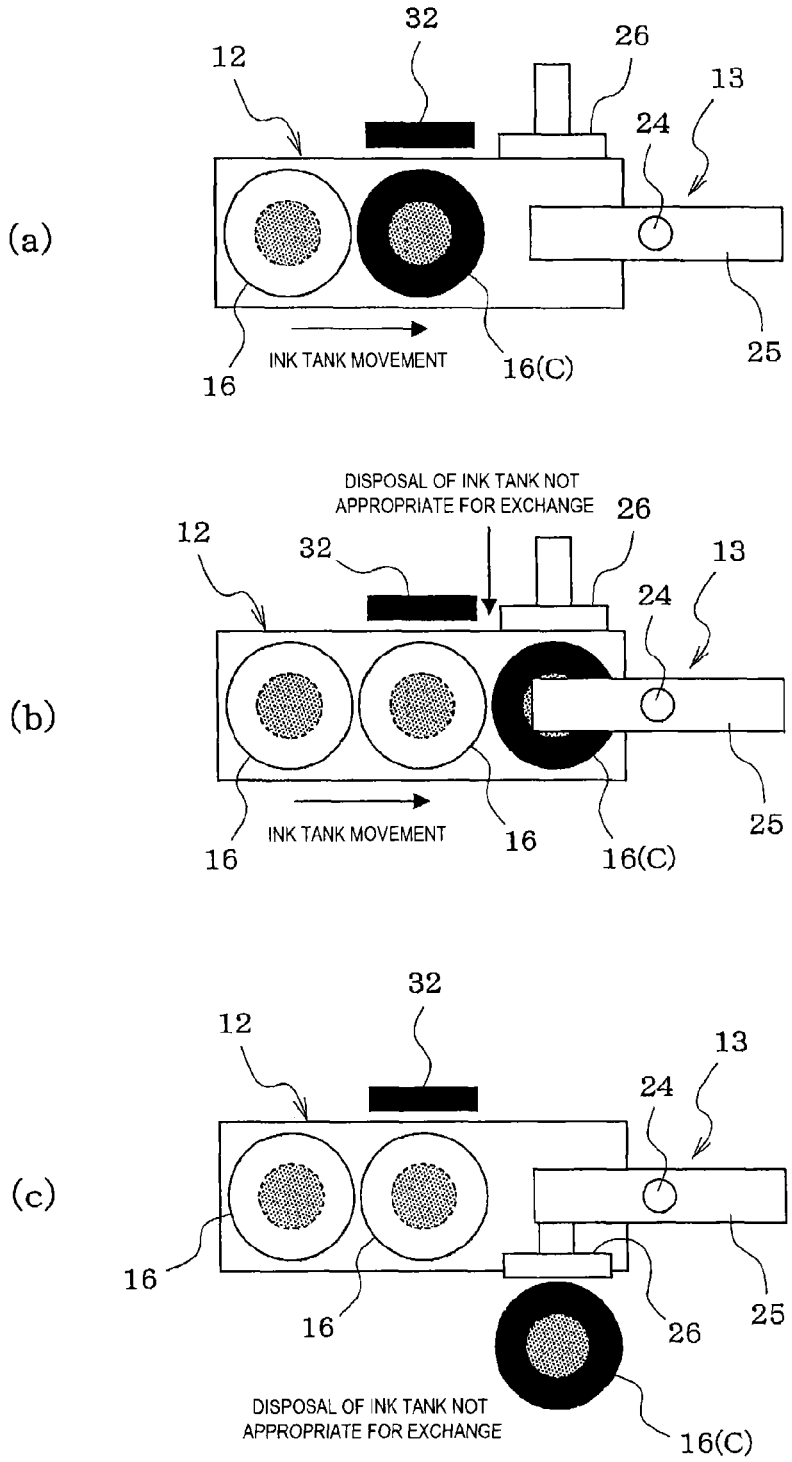
FIG. 4 (*a*) to (*c*) are diagrams illustrating the disposal operation of an ink tank which is not appropriate for exchange of embodiment 2 of the present disclosure.

Next, embodiment 2 of the present disclosure is explained using FIG. 3 and FIG. 4. However, for sections which are practically the same as the above embodiment 1, the same symbols are used and explanations are omitted or abbreviated, with the sections which are largely different being described.

With embodiment 2, ink information registration means 31 on which ink information is registered (recorded or memorized) is provided on the ink tanks 16 stored in tank storage unit 12. Here, as ink information registration means 31, it is acceptable to use a code label with ink information registered with a code such as a barcode or 2D code, and it is acceptable to use an electronic tag (also known as an RF tag, wireless tag, IC tag, electromagnetic wave tag, and so on) memorized with the ink information in a digital format.

It is fine if ink information registered in ink information registration means 31 includes at least the ink usage expiry period and/or ink type, but it is also acceptable to include items such as ink storage temperature (the target control temperature for temperature control means 21). It is acceptable for the position of ink information registration means 31 to be, for example, at cap section 20, and it is acceptable to be on the side or bottom of ink tank 16.

On the other hand, ink information reading means 32 (reader) for reading the ink information from ink information registration means 31 of ink tank 16 is provided on tank storage unit 12, and ink information read by this ink information reading means 32 is transmitted to the control device of the inkjet printing device. With embodiment 2, as shown in FIG. 4 (*a*), ink information reading means 32 is arranged at a position one before the exchange position (the position at which ink tank 16 is gripped by arm section 25) below arm section 25 of tank exchange mechanism 13 so as to read ink information.

The control device of the inkjet printing device judges whether ink tank 16 stored inside tank storage unit 12 is an ink tank that is not appropriate for exchange (for example, the ink usage period has expired, the ink tank is for the wrong ink type, and so on) based on the ink information read at ink information reading means 32. As a result, if it is judged to be an ink tank 16 (C) which is not appropriate for exchange, ink tank 16 (C) which is not appropriate for exchange is moved to the exchange position below arm section 25 of tank exchange mechanism 13, and, as shown in FIGS. 4 (*b*) and (*c*), tank disposal means 26 operates and ink tank 16 (C) which is not appropriate for exchange is ejected from tank storage unit 12.

After that, an ink tank 16 which is appropriate for exchange is moved to the exchange position below arm section 25 of tank exchange mechanism 13, and when it is judged that the quantity of ink remaining in the ink tank 16 attached to tank attachment section 17 of head unit 11 is just about zero (equal to or below a judgment threshold value) based on the detection result of ink remaining quantity sensor 18, in the same procedure as with embodiment 1, by tank exchange mechanism 13, empty ink tank 16 attached to tank attachment unit 17 of head unit 11 is removed and ink tank 16 to be used for exchange removed from tank storage unit 12 is attached to tank attachment section 17 of head unit 11.

With embodiment 2 described above, as well as providing on ink tanks 16 an ink information registration means 31 on which is recorded or memorized ink information including at least ink usage expiry period and/or ink type, because the configuration is such that ink information reading means 32 for reading ink information from ink information registration means 31 of ink tank 16 is provided on tank storage unit 12, it is possible to prevent in advance an ink tank not appropriate for exchange (for example, the ink usage period has expired, the ink tank is for the wrong ink type, and so on) being attached to tank attachment section 17 of inkjet head 14, and it is possible to prevent in advance inkjet head 14 discharge defects and printing defects and so on.

Also, if ink storage temperature is included in the ink information registered in ink information registration means 31 and the temperature of temperature control means 21 is controlled such that it becomes the ink storage temperature, the ink inside ink tanks 16 stored in tank storage unit 12 can be maintained at the appropriate storage temperature, and deterioration of the ink can be prevented even if the ink inside the ink tank 16 is ink which is particularly susceptible to deterioration due to changes in the temperature.

With embodiment 2, the ink information reading position of ink information reading means 32 was the position one before the exchange position below arm section 25 of tank exchange mechanism 13, but it is acceptable for this to be at a position further forward than this exchange position, or at the exchange position.

Also, with embodiment 2, ink information reading means 32 was provided on tank storage unit 12, but it is also acceptable to provide ink information reading means 32 on tank exchange mechanism 13, such that ink information is read by bringing ink information reading means 32 close to ink information registration means 31 of ink tank 16 by operation of the tank exchange mechanism 13.

Embodiment 3

Figure 5:
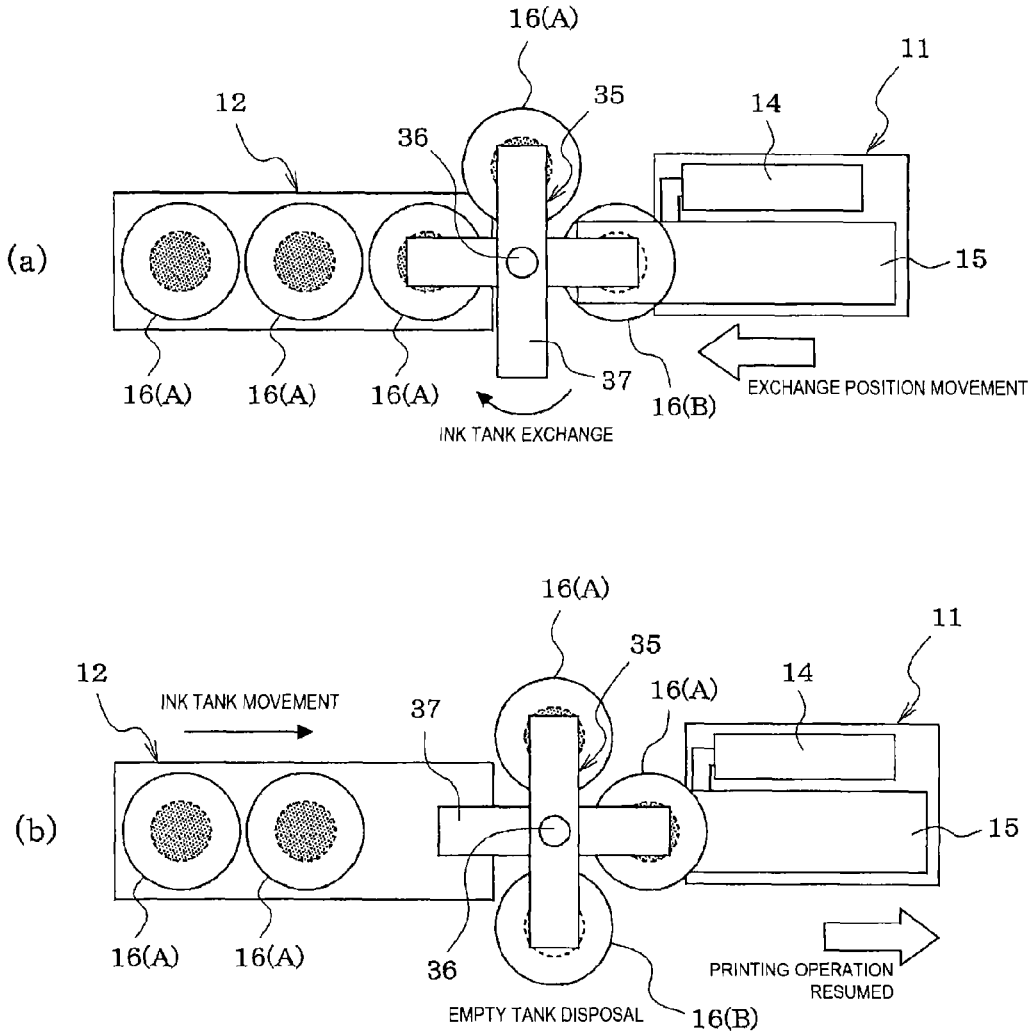
FIG. 5 (*a*) and (*b*) are diagrams illustrating the ink tank exchange operation of embodiment 3 of the present disclosure.

Next, embodiment 3 of the present disclosure is explained using FIG. 5. However, for sections which are practically the same as the above embodiment 1, the same symbols are used and explanations are omitted or abbreviated, with the sections which are largely different being described.

With embodiments 1 and 2 above, tank exchange mechanism 13 and tank disposal means 26 were provided separately, but with embodiment 3 the configuration is such that tank exchange mechanism 35 also acts as a tank disposal means, such that empty ink tanks 16 (and ink tanks not appropriate for exchange) are disposed of from tank storage unit 12 to a predetermined disposal location.

Tank exchange mechanism 35 of embodiment 3 comprises cruciform type arm section 37 which rotates horizontally, moving axis 36 connected to the center of the arm section 37, and a moving power source (not shown in the figure) such as a motor for moving arm section 37 up/down or with horizontal rotation using the moving axis 36, and a gripping member (not shown in the figure) is provided at the end of each of the four directions of the arm section 37 for respectively gripping ink tanks 16.

Cruciform type arm section 37 rotates 90 degrees in one ink tank exchange operation, and performs disposal of empty ink tank 16 (B) as well as ink tank exchange operation.

Specifically, first, as shown in FIG. 5 (*a*), as well as the gripping member on one end of arm section 37 of tank exchange mechanism 35 being operated and ink tank 16 (A) to be used for exchange inside tank storage unit 12 being gripped, the gripping member at the other end 180 degrees opposite of arm section 37 is operated and empty ink tank 16 (B) attached to tank attachment section 17 of head unit 11 is gripped. In this state, by raising arm section 37 the two ink tanks 16 (A) and 16 (B) being held at both ends are removed from tank storage unit 12 and tank attachment section 17 of head unit 11, and in this state, as shown in FIG. 5 (*b*), arm section 37 is rotated 90 degrees, and as well as empty ink tank 16 (B) being rotated 90 degrees and positioned above the disposal position and ink tank 16 (A) to be used for exchange which was gripped this time being rotated 90 degrees and held in standby, ink tank 16 (A) to be used for exchange which was gripped the previous time and which is 90 degrees further around is positioned above tank attachment section 17 of head unit 11.

In this state, by lowering arm section 37, ink tank 16 (A) to be used for exchange is attached to tank attachment section 17 of head unit 11. After this, the grip on ink tanks 16 (A) and (B) is released, empty ink tank 16 (B) is disposed of at the disposal position and arm section 37 is raised to the original standby position. By this, a state in which printing operation can be started is reached.

Here, if it is judged that an ink tank 16 stored inside tank storage unit 12 is an ink tank that is not appropriate for exchange (for example, the ink usage period has expired, the ink tank is for the wrong ink type, and so on) based on the ink information read at ink information reading means 32, the ink tank not appropriate for exchange is gripped by arm section 37 and removed from tank storage unit 12. Then, the arm section 37 rotated 90 degrees and the grip on the ink tank not appropriate for exchange released so that it is disposed of in the same disposal position as empty ink tank 16 (B).

The same effects can be achieved with the above described embodiment 3 as with the previously described embodiments 1 and 2. When applying the present invention to an inkjet printing device which uses multiple types of inks, it is fine to apply one of the configurations of the above embodiments 1 to 3 to each of the ink types.

Further, with embodiment 1 above, fixed tank 15 for storing ink to be supplied to inkjet head 14 was provided on head unit 11 and the configuration was such that ink was replenished to fixed tank 15 from the ink tank 16 attached to tank attachment section 17, but it is also acceptable to have a configuration such that fixed tank 15 is omitted from head unit 11 and ink is supplied directly to inkjet head 14 from the ink tank 16 attached to tank attachment section 17.

Furthermore, for the present invention, it goes without saying that it is possible to have an embodiment with various changes that does not extend beyond the scope of the invention such as embodiments applied to a wide range of inkjet printing devices for other uses not just limited to inkjet printing devices for drawing patterns of wiring and insulators and so on.

SYMBOL DESCRIPTIONS

11: Head unit; 12: Tank storage unit; 13: Tank exchange mechanism; 14: Inkjet head; 15: Fixed tank; 16: Ink tank; 17: Tank attachment section; 18: Ink remaining quantity sensor (ink remaining quantity detection means); 20: Cap section; 21: Temperature control means; 22: Bubble discharge means; 25: Arm section; 26: Tank disposal means; 31: Ink information registration means; 32: Ink information reading means; 35: Tank exchange mechanism; 37: Arm section

What is claimed is:

1. An inkjet printing device comprising:

a head unit including an inkjet head that prints by jetting ink onto a printing target item, and including a tank attachment section to which an ink tank to store ink supplied to the inkjet head is exchangeably attached;

a tank storage unit which stores at least one ink tank to be used for exchange;

a tank exchange mechanism which removes the ink tank attached to the tank attachment section and attaches the ink tank to be used for exchange, removed from the tank storage unit, to the tank attachment section; and a control device that controls the ink tank exchange operation of the tank exchange mechanism, wherein the at least one tank to be used for exchange is moved within the tank storage unit towards the tank exchange mechanism by an arrangement pitch of the tank storage unit.

2. The inkjet printing device according to claim 1 wherein the head unit includes a fixed tank that stores ink to be supplied to the inkjet head and ink is replenished to the fixed tank from the ink tank attached to the tank attachment section.

3. The inkjet printing device according to claim 1 wherein the head unit includes an ink remaining quantity sensor that detects at least one of the remaining quantity, a presence, and an absence of ink in the ink tank attached to the tank attachment section, and wherein the control device performs ink tank exchange operation of the tank exchange mechanism after judging an exchange period of the ink tank attached to the tank attachment section based on a detection result of the ink remaining sensor.

4. The inkjet printing device according to claim 1, wherein the tank storage unit includes an ink information registration means on which is recorded or memorized ink information including at least one of: an ink usage expiry period, a storage temperature, and an ink type, wherein the tank storage unit or the tank exchange mechanism includes an ink information reading means for reading the ink information from the ink information registration means, and wherein the control device judges whether an ink tank is not appropriate for exchange based on the ink information read by the ink information reading means.

5. The inkjet printing device according to claim 4, further comprising a tank disposal means for disposing of the ink tanks not appropriate for exchange from the tank storage unit.

6. The inkjet printing device according to claim 5 wherein the tank exchange mechanism includes the tank disposal means and removes ink tanks not appropriate for exchange from the tank storage unit and disposes of them to a predetermined disposal location.

7. The inkjet printing device according to claim 4, wherein the ink tank storage unit includes a first position in which the ink tank to be used for exchange is stored and a second position in which an ink tank next to be used for exchange is stored, and wherein the ink information reading means reads the ink information registration means at the second position.

8. The inkjet printing device according to claim 1 wherein a bubble discharge means for discharging bubbles entrapped inside the ink in the storage ink tank is provided on the tank storage unit.

9. The inkjet printing device according claim 1 wherein a temperature control means for controlling the temperature of ink inside the storage ink tank to a predetermined temperature is provided on the tank storage unit.

10. The inkjet printing device according to claim 1, wherein the tank exchange mechanism includes an arm section which is rotatable around a moving axis, the arm section being configured to grip the ink tank attached to the tank attachment section and the ink tank to be used for exchange at respective ends of the arm section.

11. The inkjet printing device according to claim 10, wherein the tank exchange mechanism exchanges the ink tank attached to the tank attachment section and the ink tank to be used for exchange by rotating around the moving axis.

12. The inkjet printing device according to claim 11, wherein the control device controls the tank exchange mechanism to exchange the ink tank attached to the tank attachment section and the ink tank to be used for exchange.

13. The inkjet printing device according to claim 1, further comprising:

a tank disposal means for disposing of an ink tank formerly attached to the tank attachment section after the tank exchange mechanism performs a tank exchange process.

14. The inkjet printing device according to claim 13, wherein the ink tank formerly attached to the tank attachment section is loaded into the tank storage unit by the tank exchange mechanism and then ejected from the tank storage unit by the tank disposal means.

* * * * *